US008850702B2

(12) United States Patent
Hall et al.

(10) Patent No.: US 8,850,702 B2
(45) Date of Patent: Oct. 7, 2014

(54) CABLE CONSOLIDATION WITH A LASER

(75) Inventors: Peter Hall, Andover, MN (US); Haiping Shao, Plymouth, MN (US)

(73) Assignee: Cardiac Pacemakers, Inc., St. Paul, MN (US)

( * ) Notice: Subject to any disclaimer, the term of this patent is extended or adjusted under 35 U.S.C. 154(b) by 1138 days.

(21) Appl. No.: 12/786,150

(22) Filed: May 24, 2010

(65) Prior Publication Data

US 2010/0299921 A1 Dec. 2, 2010

Related U.S. Application Data

(60) Provisional application No. 61/181,169, filed on May 26, 2009.

(51) Int. Cl.
*H01R 43/02* (2006.01)
*H01R 13/02* (2006.01)

(52) U.S. Cl.
CPC ..... *H01R 43/0221* (2013.01); *H01R 13/025* (2013.01); *H01R 2201/12* (2013.01); *Y10S 439/909* (2013.01)
USPC ..... 29/878; 29/874; 29/884; 29/885; 607/116; 607/119; 607/122; 174/36; 174/88 C; 174/75 C; 439/909; 439/874

(58) Field of Classification Search
CPC ..... H01R 43/005; H01R 43/0228; H01R 43/0221
USPC ..... 29/874, 876, 884, 885, 875, 877, 878; 607/116, 37, 119, 122; 174/36, 88 C, 174/742, 75 C, 117 F, 117 FF; 439/909, 874
See application file for complete search history.

(56) References Cited

U.S. PATENT DOCUMENTS

| | | | | |
|---|---|---|---|---|
| 3,794,522 | A * | 2/1974 | Mueller et al. | 134/1 |
| 4,751,365 | A * | 6/1988 | La Rocca et al. | 219/121.64 |
| 4,931,616 | A * | 6/1990 | Usui et al. | 219/121.68 |
| 4,952,012 | A * | 8/1990 | Stamnitz | 385/101 |
| 4,999,472 | A * | 3/1991 | Neinast et al. | 219/56.22 |
| 5,057,661 | A * | 10/1991 | Banner | 219/56.22 |
| 5,085,114 | A * | 2/1992 | DeRoss et al. | 83/861 |
| 5,143,089 | A | 9/1992 | Alt | |
| 5,269,056 | A | 12/1993 | Yang et al. | |
| 5,330,523 | A * | 7/1994 | Campbell et al. | 607/129 |
| 5,361,653 | A * | 11/1994 | Pradin | 81/9.51 |
| 5,483,022 | A | 1/1996 | Mar | |
| 5,487,758 | A | 1/1996 | Hoegnelid et al. | |
| 5,676,694 | A | 10/1997 | Boser et al. | |
| 5,679,022 | A | 10/1997 | Cappa et al. | |
| 5,760,341 | A | 6/1998 | Laske et al. | |
| 5,845,396 | A | 12/1998 | Altman et al. | |
| 5,851,227 | A | 12/1998 | Spehr | |
| 5,876,430 | A | 3/1999 | Shoberg et al. | |
| 5,876,431 | A | 3/1999 | Spehr et al. | |
| 5,957,967 | A | 9/1999 | Laske | |
| 6,052,625 | A | 4/2000 | Marshall | |
| 6,061,595 | A * | 5/2000 | Safarevich | 607/37 |

(Continued)

*Primary Examiner* — Peter DungBa Vo
*Assistant Examiner* — Kaying Kue
(74) *Attorney, Agent, or Firm* — Faegre Baker Daniels LLP

(57) ABSTRACT

The embodiments herein relate to a conductor cable for use in a lead and more specifically to methods and devices related to laser consolidation of the cable. The various conductor cable embodiments and methods provide for at least one end of the cable having a weld mass created by a laser welding process.

15 Claims, 7 Drawing Sheets

(56) References Cited

U.S. PATENT DOCUMENTS

| | | | | |
|---|---|---|---|---|
| 6,066,166 | A | 5/2000 | Bischoff et al. | |
| 6,104,961 | A | 8/2000 | Conger et al. | |
| 6,129,749 | A | 10/2000 | Bartig et al. | |
| 6,256,542 | B1 | 7/2001 | Marshall et al. | |
| 6,259,954 | B1 | 7/2001 | Conger et al. | |
| 6,291,795 | B1 * | 9/2001 | Jones et al. | 219/121.63 |
| 6,321,102 | B1 | 11/2001 | Spehr et al. | |
| 6,324,415 | B1 | 11/2001 | Spehr et al. | |
| 6,326,548 | B1 * | 12/2001 | Okumura et al. | 174/88 C |
| 6,373,026 | B1 * | 4/2002 | Kurosawa et al. | 219/121.72 |
| 6,381,835 | B1 | 5/2002 | Conger et al. | |
| 6,456,888 | B1 * | 9/2002 | Skinner et al. | 607/116 |
| 6,477,429 | B1 | 11/2002 | Conger et al. | |
| 6,477,767 | B1 * | 11/2002 | Zhao | 29/828 |
| 6,501,991 | B1 | 12/2002 | Honeck et al. | |
| 6,563,080 | B2 * | 5/2003 | Shapovalov et al. | 219/121.72 |
| 6,615,695 | B1 * | 9/2003 | Hjelle et al. | 82/1.11 |
| 6,640,436 | B1 * | 11/2003 | Kimura et al. | 29/867 |
| 6,650,921 | B2 | 11/2003 | Spehr et al. | |
| 6,737,605 | B1 * | 5/2004 | Kern | 219/121.67 |
| 6,741,894 | B2 | 5/2004 | Michel | |
| 6,801,809 | B2 | 10/2004 | Laske et al. | |
| 6,875,949 | B2 | 4/2005 | Hall | |
| 6,940,366 | B2 * | 9/2005 | Komiya | 333/181 |
| 7,138,582 | B2 | 11/2006 | Lessar et al. | |
| 7,155,294 | B2 | 12/2006 | Alinder | |
| 7,168,165 | B2 | 1/2007 | Calzada et al. | |
| 7,174,220 | B1 | 2/2007 | Chitre et al. | |
| 7,598,456 | B2 * | 10/2009 | Mertel | 174/84 R |
| 7,622,679 | B2 * | 11/2009 | Huang et al. | 174/107 |
| 7,787,961 | B1 * | 8/2010 | Safarevich et al. | 607/116 |
| 8,530,741 | B2 * | 9/2013 | Kojima et al. | 174/34 |
| 2001/0003333 | A1 * | 6/2001 | Neven | 219/121.72 |
| 2003/0001606 | A1 * | 1/2003 | Bende et al. | 324/762 |
| 2003/0066187 | A1 * | 4/2003 | Zhao | 29/828 |
| 2004/0134965 | A1 * | 7/2004 | Stepan | 228/1.1 |
| 2005/0046521 | A1 * | 3/2005 | Komiya | 333/202 |
| 2005/0107858 | A1 * | 5/2005 | Bluger | 607/115 |
| 2006/0047223 | A1 | 3/2006 | Grandfield et al. | |
| 2006/0157267 | A1 * | 7/2006 | Morijiri | 174/117 F |
| 2006/0200217 | A1 * | 9/2006 | Wessman | 607/116 |
| 2006/0206185 | A1 * | 9/2006 | Schuller | 607/137 |
| 2006/0253180 | A1 | 11/2006 | Zarembo et al. | |
| 2008/0004683 | A1 | 1/2008 | Wengreen et al. | |
| 2008/0140072 | A1 * | 6/2008 | Stangenes et al. | 606/41 |
| 2009/0095723 | A1 * | 4/2009 | Nakamae | 219/121.72 |
| 2009/0099635 | A1 | 4/2009 | Foster | |
| 2009/0192577 | A1 | 7/2009 | Desai | |
| 2009/0318999 | A1 | 12/2009 | Hall | |
| 2010/0234929 | A1 | 9/2010 | Scheuermann | |
| 2010/0282487 | A1 * | 11/2010 | Tanaka | 174/102 R |
| 2010/0305670 | A1 * | 12/2010 | Hall et al. | 607/115 |
| 2011/0306235 | A1 * | 12/2011 | Tanaka et al. | 439/578 |
| 2012/0037394 | A1 * | 2/2012 | Kojima et al. | 174/34 |
| 2012/0212317 | A1 * | 8/2012 | Bulmer et al. | 338/214 |

* cited by examiner

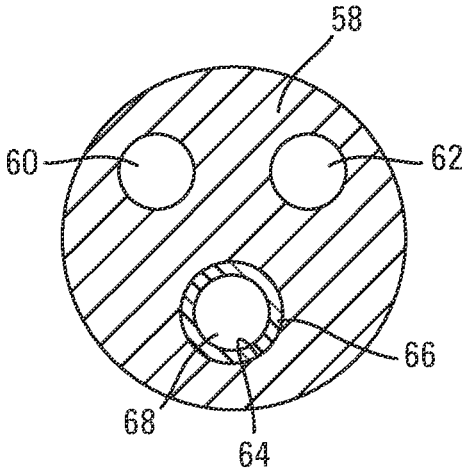
Fig. 3
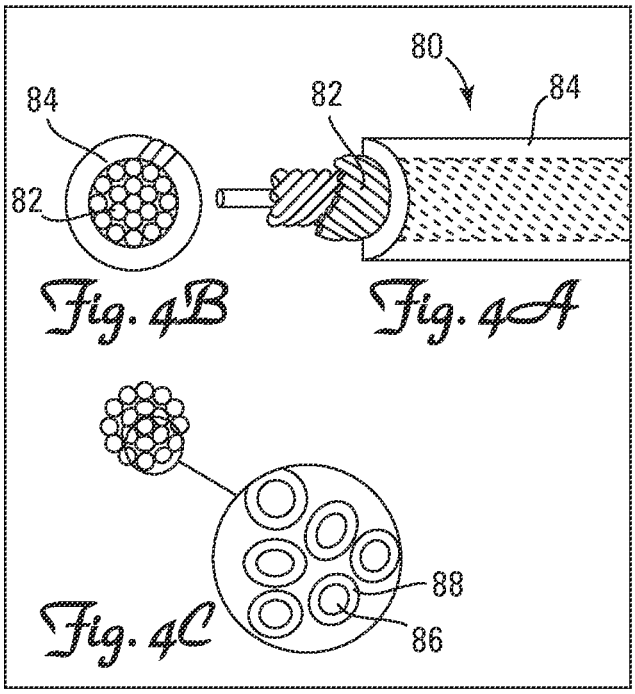

CABLE CONSOLIDATION WITH A LASER

CROSS-REFERENCE TO RELATED APPLICATION

This application claims priority under 35 U.S.C. §119 to U.S. Provisional Application No. 61/181,169, filed on May 26, 2009, entitled "Cable Consolidation with a Laser," which is incorporated herein by reference in its entirety for all purposes.

TECHNICAL FIELD

The various embodiments disclosed herein relate to body implantable medical devices for sensing electrical impulses and/or delivering electrical stimulation in a body, and more particularly, to methods and devices relating to a conductor cable consolidated with a laser.

BACKGROUND

Various types of medical electrical leads for use in cardiac rhythm management systems are known. Such leads are typically extended intravascularly to an implantation location within or on a patient's heart, and thereafter coupled to a pulse generator or other implantable device for sensing cardiac electrical activity, delivering therapeutic stimuli, and the like. The leads are desirably highly flexible to accommodate natural patient movement, yet also constructed to have minimized profiles. At the same time, the leads are exposed to various external forces imposed, for example, by the human muscular and skeletal system, the pulse generator, other leads, and surgical instruments used during implantation and explantation procedures. There is a continuing need for improved lead designs.

SUMMARY

Example 1 relates to a method of preparing an end of an insulated multi-filar conductor cable for use in an implantable medical electrical lead. The multi-filar cable has a plurality of filars made of a filar material and an insulation component disposed about the cable at least proximate the end of the cable. The method includes positioning the multi-filar cable in a fixture while leaving the insulation component proximate the end of the cable intact, and further includes applying laser energy to the end of the cable to form a weld mass joining all of the filars proximate the end of the cable. The weld mass consists substantially entirely of the filar material.

In Example 2, the method of Example 1 in which each of the plurality of filars comprise a core and an outer layer.

In Example 3, the method of Example 2 in which the core includes a conductive material and the outer layer includes a highly corrosion-resistant material.

In Example 4, the method of any of Examples 1-3 in which the weld mass is shaped like a bead.

In Example 5, the method of any of Examples 1-4 in which the method further includes removing a portion of the insulation component at the end of the cable, whereby a length of the cable at the end of the cable is exposed.

Example 6 relates to a method of consolidating a plurality of filars of a multi-filar cable. The method includes positioning the multi-filar cable and melting the plurality of filars at an end of the multi-filar cable with a laser without removing the insulation component and without adding any additional material to the end of the cable, whereby a weld is formed at the end of the cable. The multi-filar cable includes an insulation component disposed around the plurality of filars.

In Example 7, the method of Example 6 in which the multi-filar cable is a conductor cable.

In Example 8, the method of Example 6 or Example 7 in which positioning the multi-filar cable includes securing the cable at a point adjacent to the end of the cable.

In Example 9, the method of Example 8 in which securing the cable includes securing the cable with a fixture.

In Example 10, the method of any of Examples 6-9 in which each of the filars includes a highly electrically conductive core disposed within a highly corrosion-resistant outer layer.

In Example 11, the method of Example 10 in which melting the plurality of filars further includes substantially covering the highly electrically conductive core of each of the plurality of filars with the weld mass, thereby protecting the highly electrically conductive core from corrosion.

In Example 12, the method of Example 10 or Example 11 in which the weld mass includes a mixture of material from the highly electrically conductive core and the highly corrosion-resistant outer layer.

Example 13 relates to a method of forming a weld mass on an end of a multi-filar cable. The method includes providing a multi-filar cable, positioning the cable for exposure to a laser, and melting together the plurality of filars at the exposed end of the cable with the laser without adding any additional material to the end of the cable, whereby a weld is formed. The multi-filar cable has a plurality of filars, an outer insulation layer disposed around the plurality of filars, and an exposed end wherein each filar of the cable is exposed. Each of the plurality of filars includes a conductive core and an external corrosion-resistant coating. The weld has substantially a corrosion-resistant coating and is configured to protect the conductive core of each of the plurality of filars from corrosion.

In Example 14, the method of Example 13 in which the melting together step further includes melting together material from the corrosion-resistant coating and material from the conductive core of each of the plurality of filars, whereby a substantial portion of the conductive core material is urged to an outer portion of the weld.

In Example 15, the method of Example 13 or Example 14 in which the conductive core material on the outer portion of the weld subsequently corrodes, whereby only the corrosion-resistant material remains on the outer portion of the weld.

In Example 16, the method of any of Examples 13-15, further including removing at least a portion of the outer insulation layer after the melting step.

In Example 17, the method of any of Examples 13-16 in which the weld is bead-shaped.

In Example 18, the method of any of Examples 13-17 in which positioning the multi-filar cable further includes securing the cable at a point adjacent to the end of the cable.

In Example 19, the method of Example 18 in which securing the cable further includes using a fixture to secure the cable.

In Example 20, the method of Example 18 or Example 19 in which securing the cable at a point adjacent to the end of the cable results in a predetermined distance between the fixture and the end of the cable.

Example 21 relates to a method of processing a multi-filar conductor cable for use in an implantable medical electrical lead, the cable having a non-insulated portion. The method includes securing the cable in an apparatus, applying a tensile force to the cable using the apparatus, and applying a laser beam to a desired location on the cable to cut the cable and simultaneously form a weld mass at the desired location. In some embodiments, the weld mass consists substantially entirely of the filar material.

In Example 22, the method of Example 21 in which each of the plurality of filars include a core and an outer layer.

In Example 23, the method of Example 22 in which the core includes a conductive material and the outer layer includes a highly corrosion-resistant material.

In Example 24, the method of any of Examples 21-23 in which the weld mass is shaped like a bead.

In Example 25, the method of any of Examples 21-24, further including tilting the cable while applying the laser beam to the desired location.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

FIG. 3 is a schematic cross section drawing of a portion of a lead, according to one embodiment.

FIG. 4A is a schematic side cutaway view of a conductor cable, according to one embodiment.

FIG. 4B is a schematic cross section view of the conductor cable of FIG. 4A, according to one embodiment.

FIG. 4C is an expanded cross section view of the conductor cable of FIG. 4A, according to one embodiment.

Figure 1:
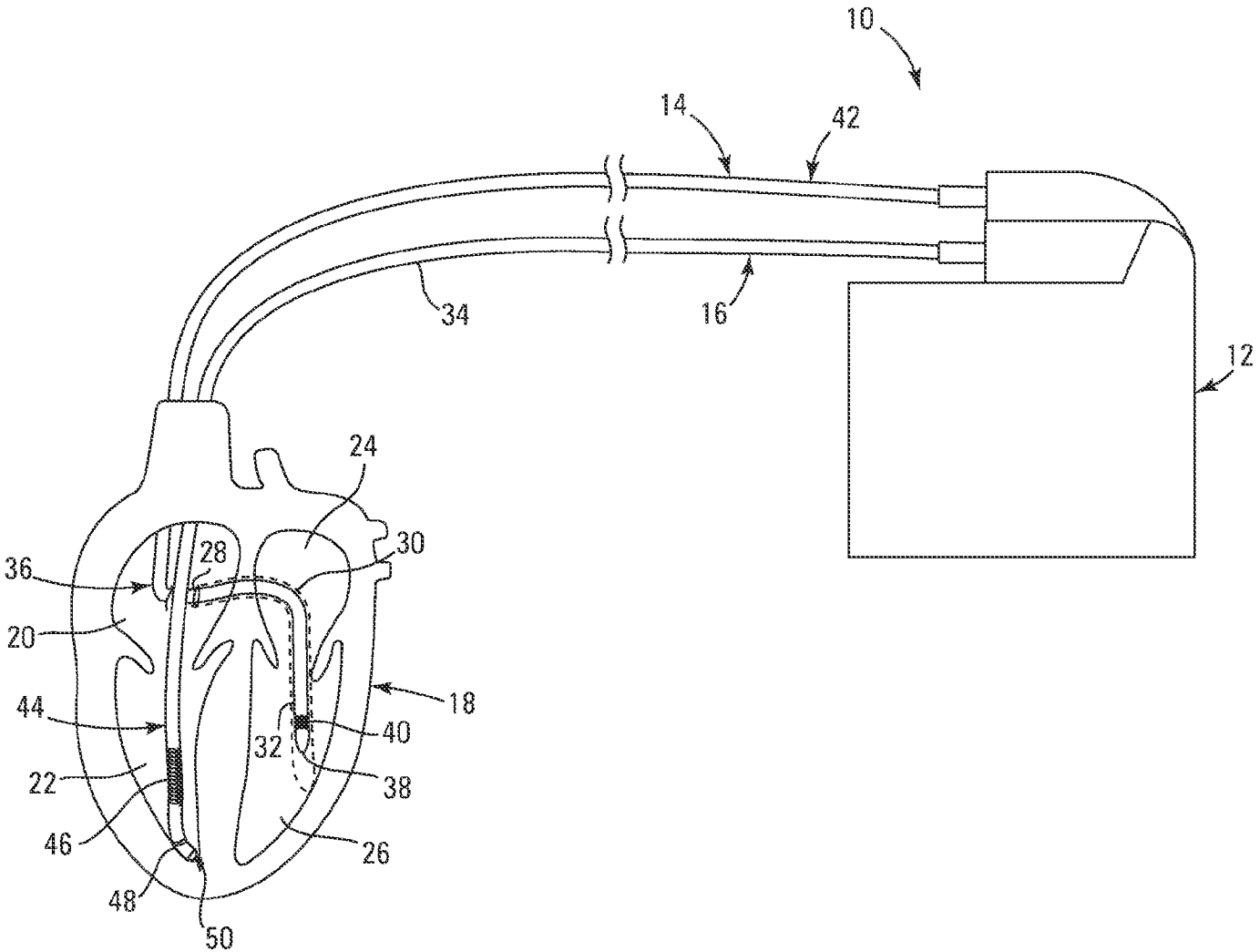
FIG. 1 is a schematic drawing of a cardiac rhythm management system including a pulse generator coupled to a pair of medical electrical leads deployed in a patient's heart, according to one embodiment.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

The various embodiments disclosed herein relate to a stranded wire conductor for use in a medical electrical lead and related methods and devices for consolidating the cable strands of the conductor. The leads according to the various embodiments of the present invention are suitable for sensing intrinsic electrical activity and/or applying therapeutic electrical stimuli to a patient. Exemplary applications include, without limitation, cardiac rhythm management (CRM) systems and neurostimulation systems. For example, in exemplary CRM systems utilizing pacemakers, implantable cardiac defibrillators, and/or cardiac resynchronization therapy (CRT) devices, the medical electrical leads according to embodiments of the invention can be endocardial leads configured to be partially implanted within one or more chambers of the heart so as to sense electrical activity of the heart and apply a therapeutic electrical stimulus to the cardiac tissue within the heart. Additionally, the leads formed according to embodiments of the present invention may be particularly suitable for placement in a coronary vein adjacent to the left side of the heart so as to facilitate bi-ventricular pacing in a CRT or CRT-D system. Still additionally, leads formed according to embodiments of the present invention may be configured to be secured to an exterior surface of the heart (i.e., as epicardial leads). FIG. 1 is a schematic drawing of a cardiac rhythm management system 10 including a pulse generator 12 coupled to a pair of medical electrical leads 14, 16 deployed in a patient's heart 18, which includes a right atrium 20 and a right ventricle 22, a left atrium 24 and a left ventricle 26, a coronary sinus ostium 28 in the right atrium 20, a coronary sinus 30, and various coronary veins including an exemplary branch vessel 32 off of the coronary sinus 30.

According to one embodiment, as shown in FIG. 1, lead 14 includes a proximal portion 42 and a distal portion 36, which as shown is guided through the right atrium 20, the coronary sinus ostium 28 and the coronary sinus 30, and into the branch vessel 32 of the coronary sinus 30. The distal portion 36 further includes a distal end 38 and an electrode 40 both positioned within the branch vessel 32. The illustrated position of the lead 14 may be used for delivering a pacing and/or defibrillation stimulus to the left side of the heart 18. Additionally, it will be appreciated that the lead 14 may also be partially deployed in other regions of the coronary venous system, such as in the great cardiac vein or other branch vessels for providing therapy to the left side or right side of the heart 18.

In the illustrated embodiment, the electrode 40 is a relatively small, low voltage electrode configured for sensing intrinsic cardiac electrical rhythms and/or delivering relatively low voltage pacing stimuli to the left ventricle 26 from within the branch coronary vein 32. In various embodiments, the lead 14 can include additional pace/sense electrodes for multi-polar pacing and/or for providing selective pacing site locations.

As further shown, in the illustrated embodiment, the lead 16 includes a proximal portion 34 and a distal portion 44 implanted in the right ventricle 22. In other embodiments, the CRM system 10 may include still additional leads, e.g., a lead implanted in the right atrium 20. The distal portion 44 further includes a flexible, high voltage electrode 46, a relatively low-voltage ring electrode 48, and a low voltage tip electrode 50 all implanted in the right ventricle 22 in the illustrated embodiment. As will be appreciated, the high voltage electrode 46 has a relatively large surface area compared to the ring electrode 48 and the tip electrode 50, and is thus configured for delivering relatively high voltage electrical stimulus to the cardiac tissue for defibrillation/cardioversion therapy, while the ring and tip electrodes 48, 50 are configured as relatively low voltage pace/sense electrodes. The electrodes 48, 50 provide the lead 16 with bi-polar pace/sense capabilities.

In various embodiments, the lead 16 includes additional defibrillation/cardioversion and/or additional pace/sense electrodes positioned along the lead 16 so as to provide multipolar defibrillation/cardioversion capabilities. In one exemplary embodiment, the lead 16 includes a proximal high voltage electrode in addition to the electrode 46 positioned along the lead 16 such that it is located in the right atrium 20 (and/or superior vena cava) when implanted. As will be appreciated, additional electrode configurations can be utilized with the lead 16. In short, any electrode configuration can be employed in the lead 16 without departing from the intended scope of the present invention.

The pulse generator 12 is typically implanted subcutaneously within an implantation location or pocket in the patient's chest or abdomen. The pulse generator 12 may be any implantable medical device known in the art or later developed, for delivering an electrical therapeutic stimulus to the patient. In various embodiments, the pulse generator 12 is a pacemaker, an implantable cardioverter defibrillator (ICD), a cardiac resynchronization (CRT) device configured for biventricular pacing, and/or includes combinations of pacing, CRT, and defibrillation capabilities.

Figure 2:
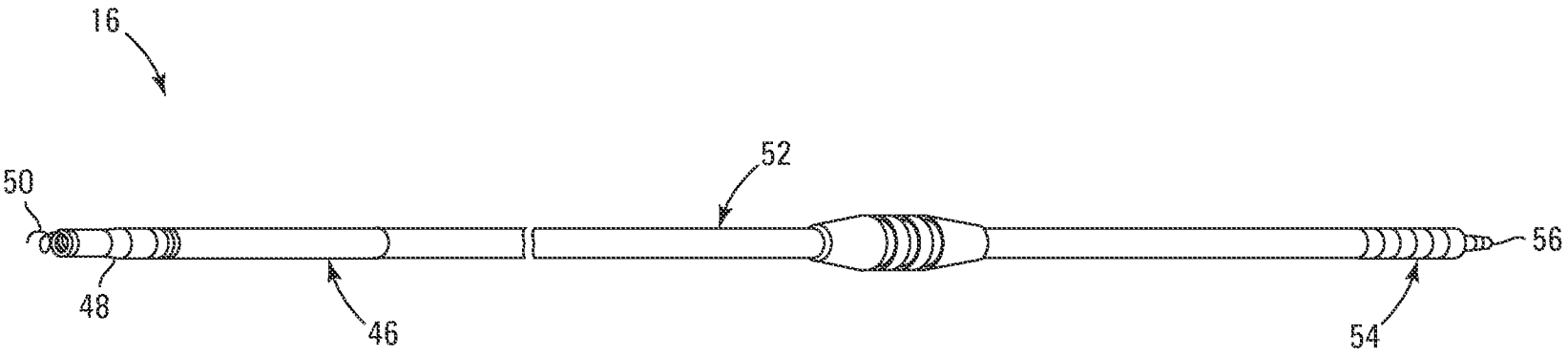
FIG. 2 is a perspective view of one of the leads shown in FIG. 1, according to one embodiment.

FIG. 2 is a perspective view of the lead 16 shown in FIG. 1. As discussed above, the lead 16 is adapted to deliver electrical pulses to stimulate a heart and/or for receiving electrical pulses to monitor the heart. The lead 16 includes an elongated polymeric lead body 52, which may be formed from any polymeric material such as polyurethane, polyamide, polycarbonate, silicone rubber, or any other known polymer for use in this type of lead.

As further shown, the lead 16 further includes a connector 54 operatively associated with the proximal end of the lead body 52. The connector 54 is configured to mechanically and electrically couple the lead 16 to the pulse generator 12 as shown in FIG. 1, and may be of any standard type, size or configuration. The connector 54 has a terminal pin 56 extending proximally from the connector 54. As will be appreciated, the connector 54 is electrically and mechanically connected to the electrodes 46, 48, 50 by way of one or more conductors (not shown) that are disposed within an elongate tubular member 58 within the lead body 52 (as best shown in FIG. 3).

In various embodiments, the elongate tubular member 58 depicted in cross section in FIG. 3 defines multiple lumens (and is also referred to herein as a "multilumen tube"). In some implementations, the multilumen tube 58 forms a central or inner portion of the lead body 52 and extends from a proximal portion to a distal portion of the body 52. As shown, in some embodiments the multilumen tube 58 has three lumens 60, 62, 64. In other embodiments, the multilumen tube 58 has a single lumen, two or more lumens, three or more lumens, four or more lumens, or any other suitable number of lumens. Further, in some embodiments one or more of the lumens are offset from the longitudinal axis of the multilumen tube 58. For example, the first lumen 60 has a longitudinal axis that is non-coaxial with respect to the longitudinal axis of the multilumen tube 58.

As mentioned above, in some embodiments the lumens 60, 62, 64 provide a passageway through which conductors can pass and electrically connect one or more of electrodes 46, 48, 50 to the connector 54. The conductors utilized may take on any configuration providing the necessary functionality. For example, as will be appreciated, the conductors coupling the electrodes 48 and/or 50 to the connector 54 (and thus, to the pulse generator 12) may be coiled conductors defining an internal lumen for receiving a stylet or guidewire for lead delivery. Conductor 66 disposed in lumen 64 is an example of a coiled conductor 66 defining an internal lumen 68. Conversely, in various embodiments, the conductor to the high voltage electrode 46 may be a multi-strand cable conductor.

An example of a stranded cable conductor is depicted in FIGS. 4A, 4B, and 4C according to one embodiment, which shows a multi-stranded cable conductor 80 comprising multiple individual strands 82 (also referred to herein as "filars") disposed within an outer insulation layer 84. FIG. 4A depicts a side view of the conductor 80 showing the insulation layer 84 disposed around the multiple filars 82, while FIG. 4B depicts a cross section of the conductor 80.

FIG. 4C depicts an expanded cross section of an implementation of the individual strands 82 in which each of the strands 82 have an electrically conductive core 86 and a outer layer 88. In one embodiment, the core 86 is a highly electrically conductive material such as silver. Alternatively, the core 86 is made of tantalum. In a further alternative, the core 86 can be made of any known material having high electrical conductivity that can be used in a conductor cable for use in a lead. In one implementation, the outer layer 88 is a high strength and corrosion resistant material such as MP35N™, available from SPS Technologies, Inc. Alternatively, the outer layer 88 is made of stainless steel. In a further alternative, the outer layer 88 is made of any high strength, high fatigue resistant material that can be used in a conductor cable for use in a lead.

In use, a cable conductor intended for insertion into a lead is cut at one end to facilitate the electrical connection with the intended target component within the lead. In addition, the insulation layer is often removed at the connection end to further facilitate electrical and mechanical connection.

Figure 5A:
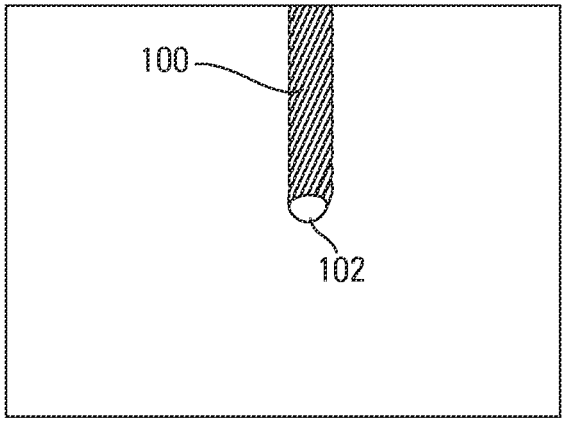
FIG. 5A is side view of a conductor cable having a weld mass at one end, according to one embodiment.
Figure 5B:
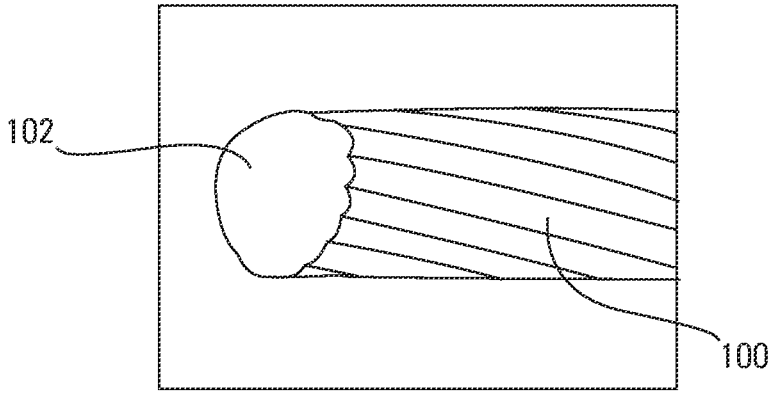
FIG. 5B is an expanded view of the conductor cable of FIG. 5A, according to one embodiment.

Various embodiments disclosed herein relate to methods and devices of consolidating the filars at the end of a cable conductor as depicted in FIGS. 5A and 5B. According to certain implementations, filar consolidation may help to prevent corrosion of the highly conductive filar cores and may also help to prevent splaying of the filars. The figures depict a conductor cable 100 with a weld mass 102 at the end of the cable 100.

Figure 6A:
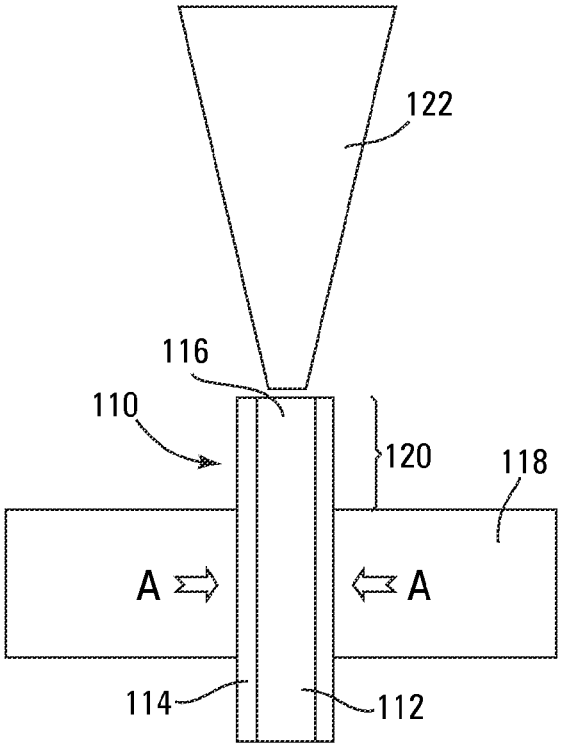
FIG. 6A is a schematic drawing of a conductor cable positioned adjacent to a laser, according to one embodiment.
Figure 6B:
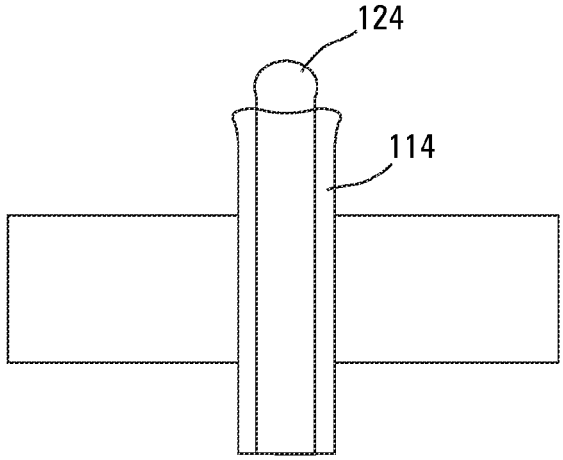
FIG. 6B is a schematic drawing of the conductor cable of FIG. 6A after the welding process is complete, according to one embodiment.

One embodiment of a method of forming a weld mass at the end of a cable using laser radiation is depicted in FIGS. 6A and 6B. As shown in FIG. 6A, the cable 110 is positioned such that the cable distal end 116 is in proximity with the laser (not shown). One way to ensure correct positioning of the cable end 116, according to one embodiment, is to use a positioning fixture 118 that engages or grips the cable 110 at a location that is adjacent to but in a proximal direction from the distal end 116 of the cable 110. The arrows A show the direction that the positioning fixture components 118 move to engage the cable 110. According to one implementation, there is a predetermined gap 120 between the positioning fixture 118 and the cable end 116.

Once the cable 110 and laser are positioned appropriately, the radiation from the laser beam 122 is aimed at and hits the cable end 116. According to one exemplary embodiment in which the cable is a 0.007" diameter 1×19 cable constructed with 0.0014" diameter, 33% Ag-cored MP35N cable filars, the amount of radiation applied to the cable end 116 takes the form of about 1 to about 4 pulses of energy at about 190 millijoules ("mJ") per pulse. Of course, it is understood that the amount of energy or radiation applied in these various embodiments varies widely depending on the size, type, and dimensions of the cable components and the laser. Alternatively, the amount of laser radiation (power and pulses) can be any amount sufficient to create a weld mass at the cable end 116 and/or ensure complete fusion or combination of the strands. In one exemplary implementation, the greater the number of pulses, the larger the diameter of the weld mass.

According to certain embodiments of the welding process described above, the resulting weld mass has a diameter that does not exceed the diameter of the cable itself. Alternatively, the weld mass diameter does not exceed the cable diameter by an amount that is large enough such that the weld mass diameter prevents the cable from being inserted into a lead lumen. In accordance with certain embodiments, the process can reliably produce a high percentage of cables with weld masses that can be used in standard lead procedures and devices.

In one embodiment, the laser is a Lasag™ SLS 200 CL16 Pulsed Nd:YAG Laser. Alternatively, the laser can be any Nd:YAG laser. In a further alternative, the laser can be any known laser for forming a weld mass on a cable for use in a medical device.

The application of the laser beam melts the filars at the distal end 116 of the cable 110, causing the highly conductive material of the filar cores to mix with the outer layer material to form a weld mass 124 as best shown in FIG. 6B. In one embodiment, the weld mass has a substantially bead-like shape (and can be referred to as a "bead"). Alternatively, the weld mass has any known shape as a result of the filars being melted together into a combination.

According to one implementation, the insulation layer 114 disposed around the cable filars 112 is not removed but instead is retained during the welding process. In this embodiment, the insulation layer 114 helps to hold the filars 112 in place during welding. As shown in FIG. 6B, the laser beam causes the insulation layer 114 adjacent to the weld mass 124 to melt and distort, but the layer 114 doesn't impede or harm the formation of the weld.

Figure 7A:
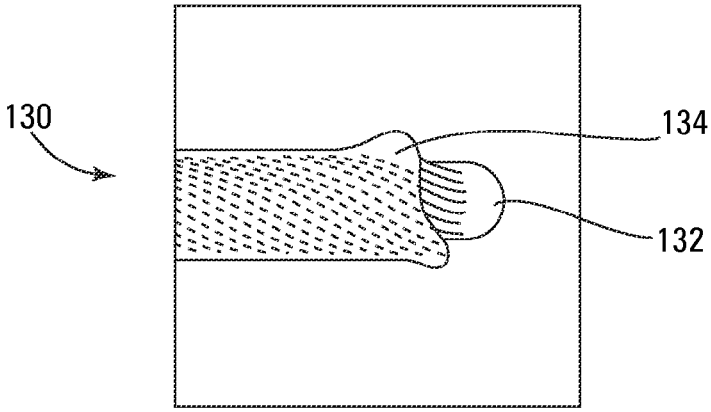
FIG. 7A is a side view of a conductor cable having a weld mass at one end and an insulation layer, according to one embodiment.
Figure 7B:
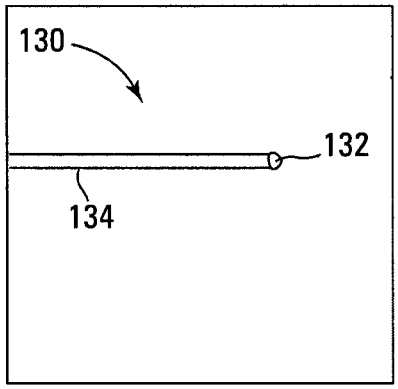
FIG. 7B is a side view of the conductor cable of FIG. 7A with the insulation layer stripped away from the distal end of the cable, according to one embodiment.

FIGS. 7A and 7B depict a conductor cable 130 with a weld mass 132 formed as a result of the welding process described above. In FIG. 7A, the insulation layer 134 is still in place immediately adjacent to the weld mass 132. Once the welding process has been completed and the weld mass 132 is formed, the insulation layer 134 can be removed for some distance from the weld mass 132 as best shown in FIG. 7B to prepare the cable 130.

Figure 8:
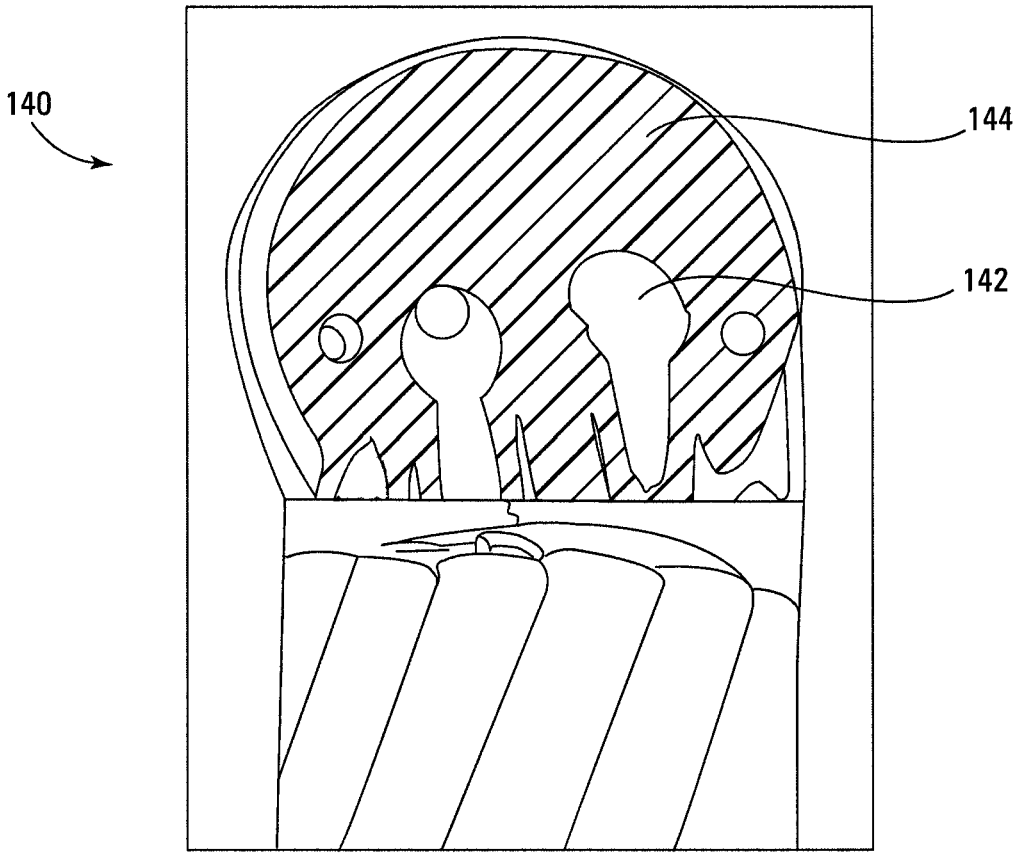
FIG. 8 is a cross section of a weld mass, according to one embodiment.

FIG. 8 depicts a cross section of a weld mass 140, according to one embodiment. The weld mass 140 is made up of a mixture of the highly conductive filar core material 142 and the highly corrosion-resistant outer layer material 144. According to some implementations such as that shown in FIG. 8, the weld mass 140 is made up of mostly the outer layer material 144, with substantially less of the mass 140 being made up of the conductive (and less corrosion-resistant) material 142. In this embodiment, the core material is silver 142 and the outer layer material is MP35N™ 144. Thus, even if any of the small amount of highly conductive core material 142 that is on an outer, exposed surface of the weld mass 140 corrodes, what remains is a weld mass 140 with an external surface that is made up entirely of the outer layer material 144.

In one implementation, the formation of a weld mass 140 in the configuration shown in FIG. 8 (and as described above) is achieved at least in part because the conductive silver 142 has a lower melting point than MP35N™ 144 and has limited solubility, if any, in MP35N™ 144. Thus, as the weld mass 140 cools after the welding process, the MP35N™ 144 solidifies before the silver 142 and the still-liquid silver 142 is rejected or forced from the solidifying weld mass and thus forms a thin layer on the outer surface of the weld mass 140 and then solidifies, as shown in FIG. 8. As a result, as mentioned above, even if the thin layer of conductive material 142 shown on the outer surface of the weld mass 140 corrodes, what remains is the weld mass 140 formed mostly of the outer layer material 144.

As will be appreciated, the conductor cable embodiments having a weld mass that consolidates the cable filars as discussed above can be used with leads for implantation in the coronary venous system, right sided bradycardia or tachycardia leads, right atrial leads, and epicardial leads.

Figure 9:
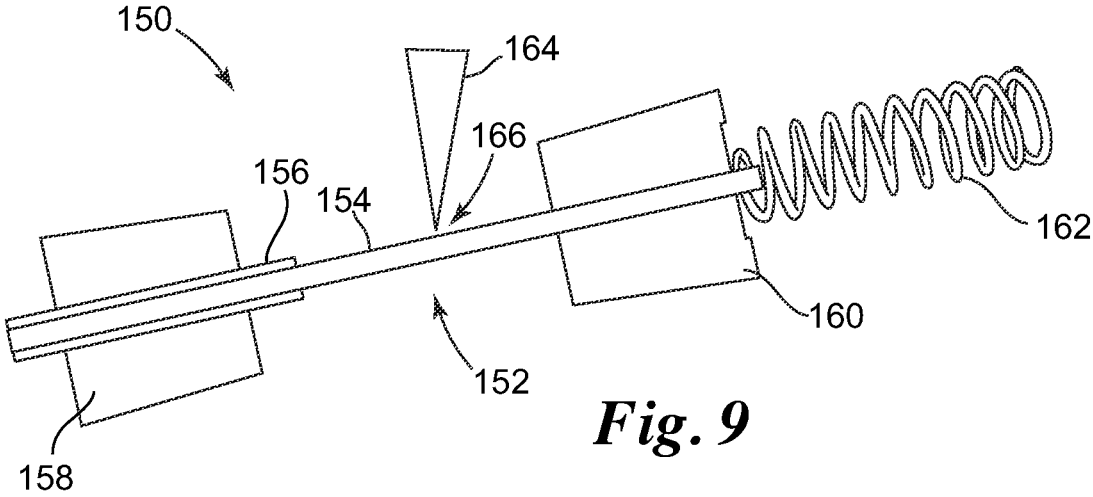
FIG. 9 is a schematic illustration of a cable processing apparatus, according to one embodiment.

In some embodiments, the conductor cable may be cut to length and a weld mass consolidating the cable filars may be formed at the location where the cut occurred simultaneously or at least substantially simultaneously with the cut. FIG. 9 provides a schematic illustration of a cable processing apparatus 150 that may be used to process a cable 152 that is similar in many respects to the cable 110 previously described. In some embodiments, the cable 152 may include a plurality of individual filars each having a silver core and an MP35N coating. The individual filars together form a metal core 154 that is surrounded by an insulation layer 156. As can be seen, at least a portion of the insulation layer 156 has been removed before inserting the cable 152 into the cable processing apparatus 150.

In some embodiments, as illustrated, the cable processing apparatus 150 includes a left hand collet 158 and a right hand collet 160. It is understood that use of the terms "left" and "right" in this embodiment are merely illustrative. The left hand collet 158 and the right hand collet 160 may be configured to releasably secure the cable 152. In some embodiments, the left hand collet 158 may be stationary while the right hand collet 160 may be subjected to a spring force to exert a tensile force on the cable 152. In some cases, a spring 162 (as illustrated) or a precision frictionless air cylinder may be used to apply an appropriate force to the cable 152 in order to separate the cable 152 at a desired location 166 while the cable 152 is being cut. If the applied force is too low, the cable 152 may melt and resolidify without being cut into two pieces. Alternatively, if the applied force is too high, an irregular-shaped weld mass may be formed.

A laser beam 164 may be applied to the desired location 166 on the cable 152 between the left hand collet 158 and the right hand collet 160. The laser beam 164 cuts a bare (no insulation) portion of the cable 154 and at the same time forms a weld mass. Any suitable laser, including the Lasag™ SLS 200 CL16 Pulsed Nd:YAG Laser described above, may be used. While only a single laser beam 164 is illustrated, in some embodiments, two or more laser beams 164 may impinge on the desired location 166. If two or more laser beams 164 are used, they may come from distinct lasers or may be optically split from a single laser.

In some embodiments, the cable 152 may be held in a horizontal position, a vertical position or at any desired intervening angle while the laser beam 164 impinges on the desired location 166, depending on the desired weld mass shape. For example, in some embodiments, the cable 152 may be held in a vertical position if a flatter weld mass is desired. In some embodiments, the cable 152 may be held in a horizontal position, particularly if the specific shape of the weld mass is not important.

Figure 10A:
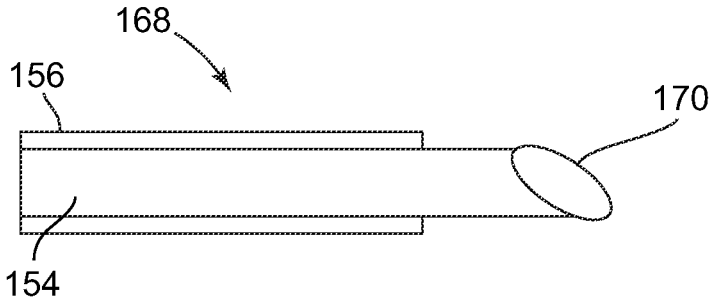
FIG. 10A is a schematic illustration of a cable that has been processed using the apparatus of FIG. 9, according to one embodiment.
Figure 10B:
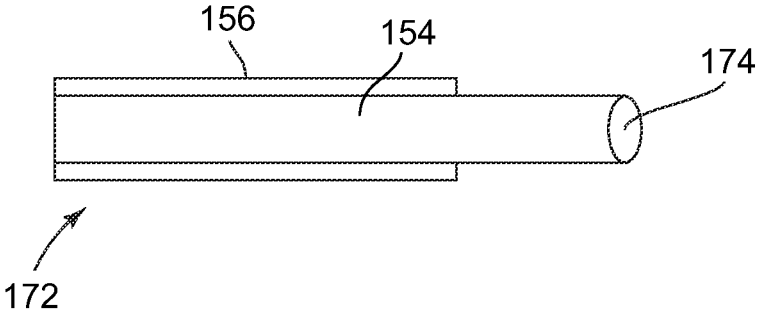
FIG. 10B is a schematic illustration of a cable that has been processed using the apparatus of FIG. 9, according to another embodiment.

In some embodiments, it may be desirable to hold the cable 152 tilted at an appropriate angle during laser processing such that gravity and the viscosity of the molten material form a desirably shaped weld mass. FIG. 10A illustrates a processed cable 168 that was not tilted. It can be seen that the resulting weld mass 170 is off-center. In contrast, FIG. 10B illustrates a processed cable 172 having a well-formed weld mass 174 as a result of tilting the cable 152 at an appropriate angle. It will be appreciated that the laser spot size and laser welding time are two of the parameters that may be used to alter the desired bead size and shape. In some embodiments, the cable 152 may be tilted at an angle of about 15 degrees relative to the horizon. Alternatively, the cable can be tilted at any known angle or no angle.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

We claim:

1. A method of processing a multi-filar conductor cable for use in an implantable medical electrical lead, the multi-filar conductor cable having a non-insulated portion, the method comprising:

securing the multi-filar conductor cable in an apparatus wherein the multi-filar conductor cable comprises a plurality of filars and wherein each of the plurality of filars comprise a core and an outer layer;

applying a tensile force to the multi-filar conductor cable with the apparatus; and applying a laser beam to a desired location on the multi-filar conductor cable to cut the multi-filar conductor cable and simultaneously form a weld mass at the desired location, wherein the weld mass consists substantially entirely of a filar material, wherein the core comprises a conductive material and the outer layer comprises a highly corrosion-resistant material, wherein the applying the laser beam step further comprises melting together the conductive material and the highly corrosion-resistant material of each of the plurality of filars, whereby a substantial portion of the conductive material is urged to an outer portion of the weld mass, and wherein the conductive material on the outer portion of the weld mass subsequently corrodes, whereby only the corrosion-resistant material remains on the outer portion of the weld mass.

2. A method of processing a multi-filar conductor cable for use in an implantable medical electrical lead, the multi-filar conductor cable having a non-insulated portion, the method comprising:

securing the multi-filar conductor cable in an apparatus, wherein the multi-filar conductor cable comprises a plurality of filars and wherein each of the plurality of filars comprise a core and an outer layer, wherein the core comprises a conductive material and the outer layer comprises a highly corrosion-resistant material;

applying a tensile force to the multi-filar conductor cable via the apparatus; and applying a laser beam to a desired location on the multi-filar conductor cable to cut through the multi-filar conductor cable and simultaneously form a weld mass at the desired location, wherein the weld mass consists substantially entirely of a filar material, wherein the weld mass comprises a mixture of material from the core and the outer layer.

3. The method of claim 2, wherein the applying the laser beam step further comprises melting together the conductive material and the highly corrosion-resistant material of each of the plurality of filars, whereby a substantial portion of the conductive material is urged to an outer portion of the weld mass.

4. The method of claim 2, wherein the weld mass is shaped like a bead on a cut end of the multi-filar conductor cable.

5. The method of claim 2, further comprising tilting the multi-filar conductor cable to be angled relative to horizontal while applying the laser beam to the desired location.

6. The method of claim 2, wherein the applying the laser beam further comprises applying at least one additional laser beam the desired location.

7. The method of claim 2, wherein the multi-filar conductor cable comprises an insulated portion, and wherein the laser beam is applied to the non-insulated portion of the multi-filar conductor cable.

8. The method of claim 2, wherein the filar material is filar material of the multi-filar conductor cable.

9. The method of claim 2, wherein the tensile force is applied via the apparatus axially with respect to an axis of the multi-filar conductor cable.

10. The method of claim 2, wherein the apparatus comprises a spring operably connected to the multi-filar conductor cable to apply the tensile force to the multi-filar conductor cable.

11. A method comprising:

providing a multi-filar conductor cable for use in an implantable medical electrical lead, wherein the multi-filar conductor cable includes a filar material;

securing the multi-filar conductor cable in an apparatus, wherein the multi-filar conductor cable comprises a plurality of filars and wherein each of the plurality of filars comprise a conductive core and an outer layer comprising a highly corrosion-resistant material;

applying a tensile force to the multi-filar conductor cable, wherein the apparatus applies the tensile force to the multi-filar conductor cable; and applying a laser beam to a desired location on the multi-filar conductor cable to sever the multi-filar conductor cable and simultaneously form a weld mass at the desired location wherein applying the laser beam includes melting together the conductive material and the highly corrosion-resistant material of each of the plurality of filars, whereby a substantial portion of the conductive material is urged to an outer portion of the weld mass, wherein the weld mass consists substantially entirely of the filar material of the multi-filar conductor cable, and wherein the conductive material on the outer portion of the weld mass subsequently corrodes, whereby only the corrosion-resistant material remains on the outer portion of the weld mass.

12. The method of claim 11, further comprising tilting the multi-filar conductor cable to be angled relative to horizontal by about 15 degrees while applying the laser beam to the desired location.

13. The method of claim 11, wherein the multi-filar conductor cable comprises an insulated portion and a non-insulated portion, and wherein the laser beam is applied to the non-insulated portion of the multi-filar conductor cable.

14. The method of claim 11, wherein the tensile force is applied via the apparatus axially with respect to an axis of the multi-filar conductor cable.

15. The method of claim 11, wherein the apparatus comprises a spring operably connected to the multi-filar conductor cable to apply the tensile force to the multi-filar conductor cable.

* * * * *